US010781574B2

(12) United States Patent
Tsukamoto

(10) Patent No.: US 10,781,574 B2
(45) Date of Patent: Sep. 22, 2020

(54) SHOVEL

(71) Applicant: SUMITOMO (S.H.I.) CONSTRUCTION MACHINERY CO., LTD., Tokyo (JP)

(72) Inventor: Hiroyuki Tsukamoto, Chiba (JP)

(73) Assignee: SUMITOMO (S.H.I) CONSTRUCTION MACHINERY CO, LTD., Tokyo (JP)

( * ) Notice: Subject to any disclaimer, the term of this patent is extended or adjusted under 35 U.S.C. 154(b) by 0 days.

(21) Appl. No.: 16/020,110

(22) Filed: Jun. 27, 2018

(65) Prior Publication Data

US 2018/0305902 A1 Oct. 25, 2018

Related U.S. Application Data

(63) Continuation of application No. PCT/JP2016/088952, filed on Dec. 27, 2016.

(30) Foreign Application Priority Data

Dec. 28, 2015 (JP) ..... 2015-257352

(51) Int. Cl.
*E02F 9/26* (2006.01)
*E02F 9/22* (2006.01)
(Continued)

(52) U.S. Cl.
CPC ..... *E02F 9/262* (2013.01); *E02F 3/32* (2013.01); *E02F 3/43* (2013.01); *E02F 3/435* (2013.01);
(Continued)

(58) Field of Classification Search
CPC ..... E02F 9/262; E02F 9/20; E02F 3/43; E02F 3/32; E02F 3/435; E02F 9/265; E02F 9/22; E02F 9/123
(Continued)

(56) References Cited

U.S. PATENT DOCUMENTS 5,784,944 A * 7/1998 Tozawa et al.
7,007,415 B2 * 3/2006 Koch ..... E02F 3/437 37/348
(Continued)

FOREIGN PATENT DOCUMENTS

EP 2924182 9/2015
JP H03-052273 U 11/1991
(Continued)

OTHER PUBLICATIONS

International Search Report for PCT/JP2016/088952 dated Mar. 28, 2017.

*Primary Examiner* — Masud Ahmed
(74) *Attorney, Agent, or Firm* — IPUSA, PLLC

(57) ABSTRACT

A shovel includes a traveling undercarriage, an upper turning structure, an attachment, an end attachment position detecting device, an object detecting device, and a processor. The upper turning structure is turnably mounted on the traveling undercarriage. The attachment is attached to the upper turning structure, and includes an end attachment at an end thereof. The end attachment position detecting device is configured to detect the position of the end attachment. The object detecting device is configured to detect the position of an object. The processor is configured to control the movement of at least one of the attachment and the upper turning structure, based on the relative positional relationship between the excavation completion position of the end attachment and the position of the object.

9 Claims, 8 Drawing Sheets

(51) Int. Cl.
*E02F 9/20* (2006.01)
*E02F 3/43* (2006.01)
*E02F 3/32* (2006.01)

(52) U.S. Cl.
CPC ..... *E02F 9/20* (2013.01); *E02F 9/22* (2013.01); *E02F 9/265* (2013.01)

(58) Field of Classification Search
USPC ..... 701/50
See application file for complete search history.

(56) References Cited

U.S. PATENT DOCUMENTS 7,178,606 B2 * 2/2007 Pecchio
7,559,271 B2 * 7/2009 Komiyama ..... E02F 9/2004 91/529
8,135,518 B2 * 3/2012 Budde et al.
9,454,147 B1 * 9/2016 Friend ..... E02F 9/2045
9,580,885 B2 2/2017 Wu et al.
10,036,407 B2 * 7/2018 Rannow et al.
2006/0041361 A1 * 2/2006 Matrosov ..... E02F 3/842 701/50
2014/0257647 A1 * 9/2014 Wu et al.
2014/0362220 A1 * 12/2014 Izumikawa ..... E02F 9/26 348/148
2017/0255895 A1 * 9/2017 Kozumi ..... E02F 3/435

FOREIGN PATENT DOCUMENTS

JP H11-286967 10/1999
JP 2002-167794 6/2002
JP 3735427 1/2006
JP 2010-198519 9/2010
JP 2012-021290 2/2012
WO 2013/057758 4/2013

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2016/088952, filed on Dec. 27, 2016 and designating the U.S., which claims priority to Japanese Patent Application No. 2015-257352, filed on Dec. 28, 2015. The entire contents of the foregoing applications are hereby incorporated herein by reference.

BACKGROUND

Technical Field

The present invention relates to shovels.

Description of Related Art

Conventionally, for example, in performing excavating and loading work, an operator who operates a construction machine such as a shovel performs an excavating and loading operation to load a dump track with excavated soil. In the excavating and loading operation, the operator needs to avoid the contact of an attachment (a bucket) and an object such as the dump truck during boom raising and turning.

In view of the above-described point, as related art, a shovel that detects the position of an object present within a work area and stops a turning operation in response to determining that the attachment is highly likely to contact the object is known.

SUMMARY

According to an aspect of the present invention, a shovel includes a traveling undercarriage, an upper turning structure, an attachment, an end attachment position detecting device, an object detecting device, and a processor. The upper turning structure is turnably mounted on the traveling undercarriage. The attachment is attached to the upper turning structure, and includes an end attachment at an end thereof. The end attachment position detecting device is configured to detect the position of the end attachment. The object detecting device is configured to detect the position of an object. The processor is configured to control the movement of at least one of the attachment and the upper turning structure, based on the relative positional relationship between the excavation completion position of the end attachment and the position of the object.

DETAILED DESCRIPTION

The related-art shovel as described above stops a turning operation every time the shovel determines that there is a high possibility of contact. Accordingly, the operator has to perform an excavating and loading operation all over again each time, thus resulting in poor work efficiency and a prolonged work time.

Furthermore, in the excavating and loading operation, there is also a problem in that raising a bucket too much in order to avoid the contact of the bucket with a dump truck increases the scattering of excavated soil when discharging the soil.

In view of the above-described problems, it is desirable to provide a shovel that can improve the work efficiency and the operation performance of an excavating and loading operation.

According to an aspect of the present invention, a shovel that can improve the work efficiency and the operation performance of an excavating and loading operation is provided.

Embodiments of the present invention are described below with reference to the accompanying drawings.

Figure 1:
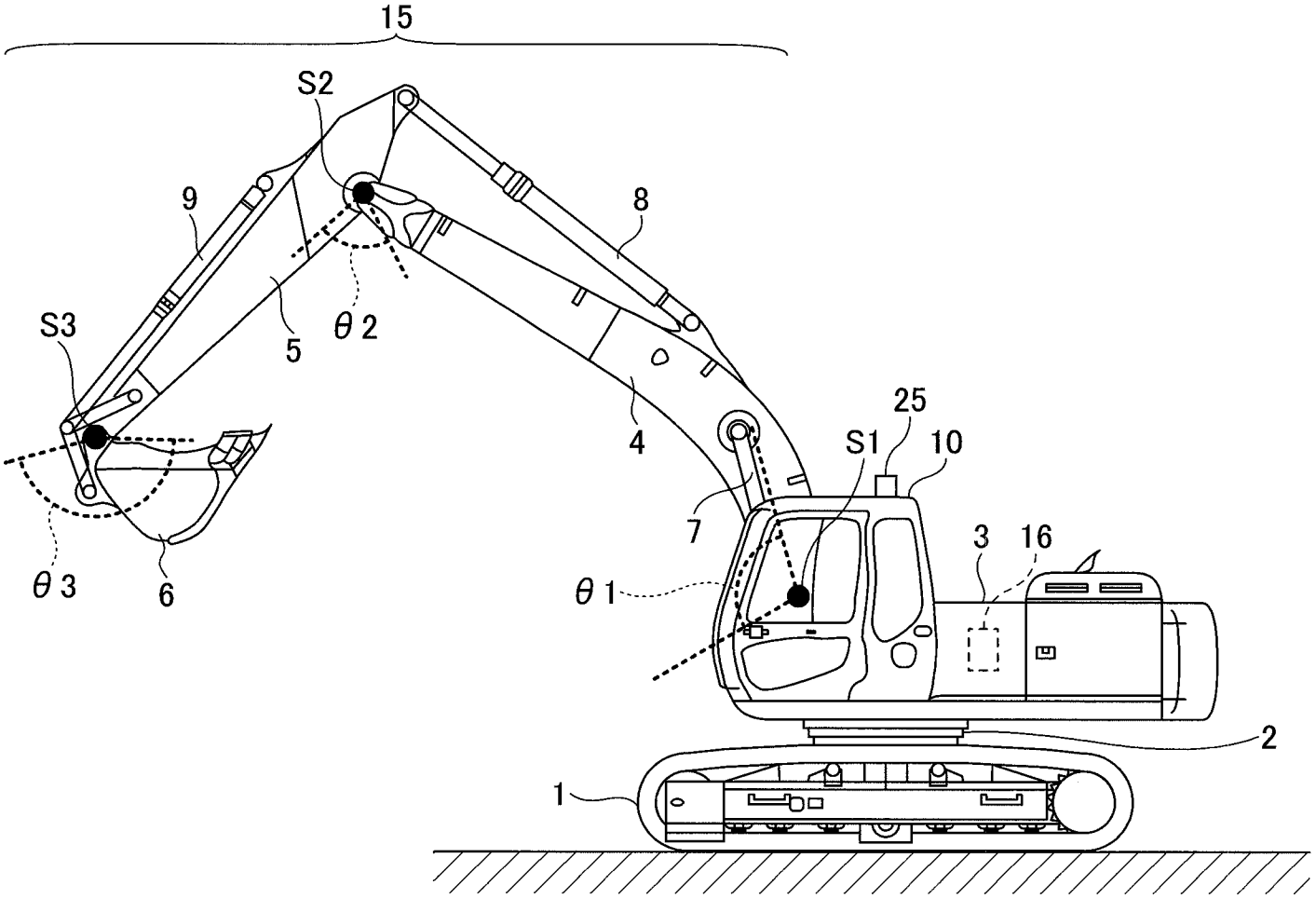
FIG. 1 is a side view of a shovel.

FIG. 1 is a side view illustrating a hydraulic shovel according to an embodiment of the present invention.

The hydraulic shovel has an upper turning structure 3 turnably mounted on a crawler traveling undercarriage 1 through a turning mechanism.

A boom 4 is attached to the upper turning structure 3. An arm 5 is attached to an end of the boom 4, and a bucket 6 serving as an end attachment is attached to an end of the arm 5. The boom 4, the arm 5, and the bucket 6 form an attachment 15. The boom 4, the arm 5, and the bucket 6 are hydraulically driven by a boom cylinder 7, an arm cylinder 8, and a bucket cylinder 9, respectively. A cabin 10 is provided and power sources such as an engine are mounted on the upper turning structure 3. In FIG. 1, the bucket 6 is illustrated as an end attachment, while the bucket 6 may be replaced with a lifting magnet, a breaker, a fork or the like.

The boom 4 is supported to be vertically pivotable relative to the upper turning structure 3. A boom angle sensor S1 serving as an end attachment position detecting device is attached to a pivot support part (joint). The boom angle sensor S1 can detect a boom angle θ1 (a climb angle from the lowermost position of the boom 4) that is the pivot angle of the boom 4. The boom angle θ1 maximizes at the uppermost position of the boom 4.

The arm 5 is supported to be pivotable relative to the boom 4. An arm angle sensor S2 serving as an end attachment position detecting device is attached to a pivot support part (joint). The arm angle sensor S2 can detect an arm angle θ2 (an opening angle from the most closed position of the arm 5) that is the pivot angle of the arm 5. The arm angle θ2 maximizes when the arm 5 is most open.

The bucket 6 is supported to be pivotable relative to the arm 5. A bucket angle sensor S3 serving as an end attachment position detecting device is attached to a pivot support part (joint). The bucket angle sensor S3 can detect a bucket angle θ3 (an opening angle from the most closed position of the bucket 6) that is the pivot angle of the bucket 6. The bucket angle θ3 maximizes when the bucket 6 is most open.

According to the embodiment of FIG. 1, each of the boom angle sensor S1, the arm angle sensor S2, and the bucket angle sensor S3 serving as an end attachment position detecting device is composed of a combination of an acceleration sensor and a gyro sensor, but may alternatively be composed of an acceleration sensor alone. Furthermore, the boom angle sensor S1, the arm angle sensor S2, and the bucket angle sensor S3 may alternatively be stroke sensors attached to the boom cylinder 7, the arm cylinder 8, and the bucket cylinder 9, rotary encoders, potentiometers or the like.

An object detecting device 25 is provided on the upper turning structure 3. The object detecting device 25 detects the distance between the shovel and an object and the height of the object. The object detecting device 25 may be, for example, a camera, a millimeter wave radar, or a combination of a camera and a millimeter wave radar. The object detecting device 25 is so placed as to be able to detect an object within 180 degrees in front or 360 degrees around the shovel. The number of object detecting devices 25 is not limited in particular. The object, which is a dump truck according to this embodiment, may also be an obstacle such as a wall or a fence.

A turning angle sensor 16 serving as an end attachment position detecting device to detect the turning angle of the upper turning structure 3 from a reference direction is provided on the upper turning structure 3. The reference direction is set by an operator. The turning angle sensor 16 can calculate a relative angle from the reference direction. The turning angle sensor 16 may be a gyro sensor.

Figure 2:
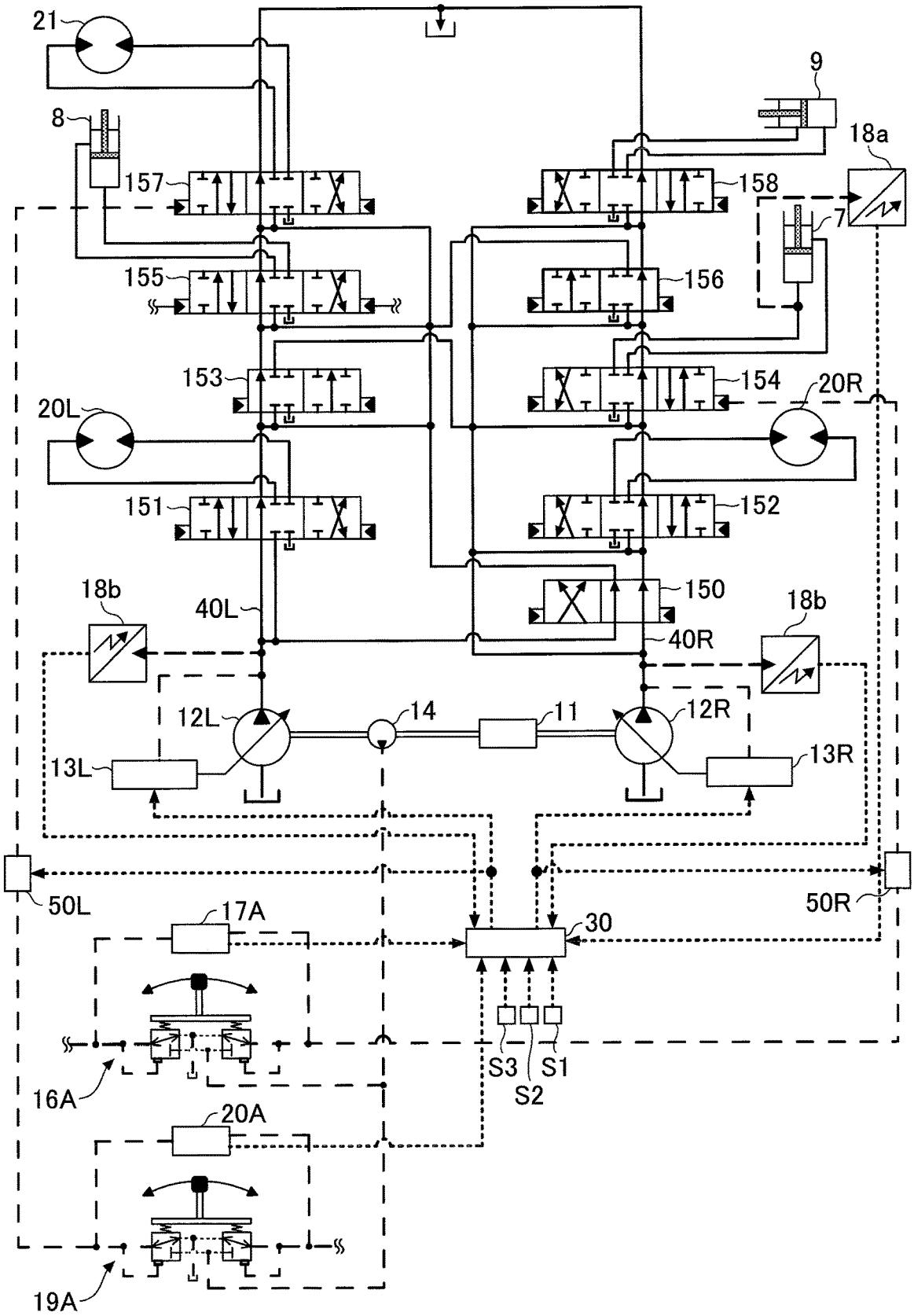
FIG. 2 is a schematic diagram illustrating a configuration of a hydraulic system installed in the shovel.

FIG. 2 is a schematic diagram illustrating a configuration of a hydraulic system installed in the hydraulic shovel according to this embodiment, showing a mechanical power system, a hydraulic line, a pilot line, and an electric drive and control system by a double line, a solid line, a dashed line, and a dotted line, respectively.

The hydraulic system circulates hydraulic oil from main pumps 12L and 12R serving as hydraulic pumps driven by an engine 11 to a hydraulic oil tank via center bypass conduits 40L and 40R.

The center bypass conduit 40L is a hydraulic line that passes through flow control valves 151, 153, 155 and 157 placed in a control valve. The center bypass conduit 40R is a hydraulic line that passes through flow control valves 150, 152, 154, 156 and 158 placed in the control valve.

The flow control valves 153 and 154 are spool valves that switch a flow of hydraulic oil in order to supply the boom cylinder 7 with hydraulic oil discharged by the main pumps 12L and 12R and discharge hydraulic oil in the boom cylinder 7 to the hydraulic oil tank.

The flow control valves 155 and 156 are spool valves that switch a flow of hydraulic oil in order to supply the arm cylinder 8 with hydraulic oil discharged by the main pumps 12L and 12R and discharge hydraulic oil in the arm cylinder 8 to the hydraulic oil tank.

The flow control valve 157 is a spool valve that switches a flow of hydraulic oil in order to circulate hydraulic oil discharged by the main pump 12L in a turning hydraulic motor 21.

The flow control valve 158 is a spool valve that switches a flow of hydraulic oil in order to supply the bucket cylinder 9 with hydraulic oil discharged by the main pump 12R and discharge hydraulic oil in the bucket cylinder 9 to the hydraulic oil tank.

Regulators 13L and 13R control the discharge quantities of the main pumps 12L and 12R by adjusting the swash plate tilt angles of the main pumps 12L and 12R in accordance with the discharge pressures of the main pumps 12L and 12R, respectively (for example, by total horsepower control).

A boom operation lever 16A is an operation apparatus for performing an operation to raise or lower the boom 4, and introduces a control pressure commensurate with the amount of lever operation into a left or a right pilot port of the boom flow control valve 154, using hydraulic oil discharged by a pilot pump 14. As a result, the stroke of a spool in the boom flow control valve 154 is controlled, so that the flow rate supplied to the boom cylinder 7 is controlled.

A pressure sensor 17A detects an operator's operation of the boom operation lever 16A in the form of pressure, and outputs a detected value to a controller 30 serving as a control part. For example, a lever operation direction and a lever operation amount (a lever operation angle) are detected.

A turning operation lever 19A is an operation apparatus for driving the turning hydraulic motor 21 to put the turning mechanism 2 into operation, and introduces a control pressure commensurate with the amount of lever operation into a left or a right pilot port of the turning flow control valve 157, using hydraulic oil discharged by the pilot pump 14. As a result, the stroke of a spool in the turning flow control valve 157 is controlled, so that the flow rate supplied to the turning hydraulic motor 21 is controlled.

A pressure sensor 20A detects an operator's operation of the turning operation lever 19A in the form of pressure, and outputs a detected value to the controller 30 serving as a control part.

Left and right traveling levers (or pedals), an arm operation lever, and a bucket operation lever (none of which is depicted) are operation apparatuses for performing operations to cause the traveling undercarriage 1 to travel; open or close the arm 5; and open or close the bucket 6, respectively. Like the boom operation lever 16A, each of these operation apparatuses introduces a control pressure commensurate with the amount of lever operation (or the amount of pedal operation) into a left or a right pilot port of a flow control valve corresponding to a hydraulic actuator, using hydraulic oil discharged by the pilot pump 14. Furthermore, the contents of the operator's operation on each of these operation apparatuses are detected in the form of pressure by a corresponding pressure sensor the same as by the pressure sensor 17A, and a detected value is output to the controller 30.

The controller 30 receives the outputs of the boom angle sensor S1, the arm angle sensor S2, the bucket angle sensor S3, the pressure sensors 17A and 20A, a boom cylinder pressure sensor 18*a*, discharge pressure sensors 18*b*, and other sensors such as a negative control pressure sensor (not depicted), and suitably outputs control signals to the engine 11, the regulators 13R and 13L, etc.

The controller 30 controls the turning operation of the upper turning structure 3 by outputting a control signal to a pressure reducing valve 50L to control a control pressure to the turning flow control valve 157. Furthermore, the controller 30 controls the boom raising operation of the boom 4 by outputting a control signal to a pressure reducing valve 50R to control a control pressure to the boom flow control valve 154.

Thus, the controller 30 adjusts control pressures related to the boom flow control valve 154 and the turning flow control valve 157 through the pressure reducing valves 50L and 50R, based on the relative positional relationship between the bucket 6 and a dump truck, in order to properly assist a boom raising and turning operation by lever operations. The pressure reducing valves 50L and 50R may be solenoid proportional valves.

Figure 3:
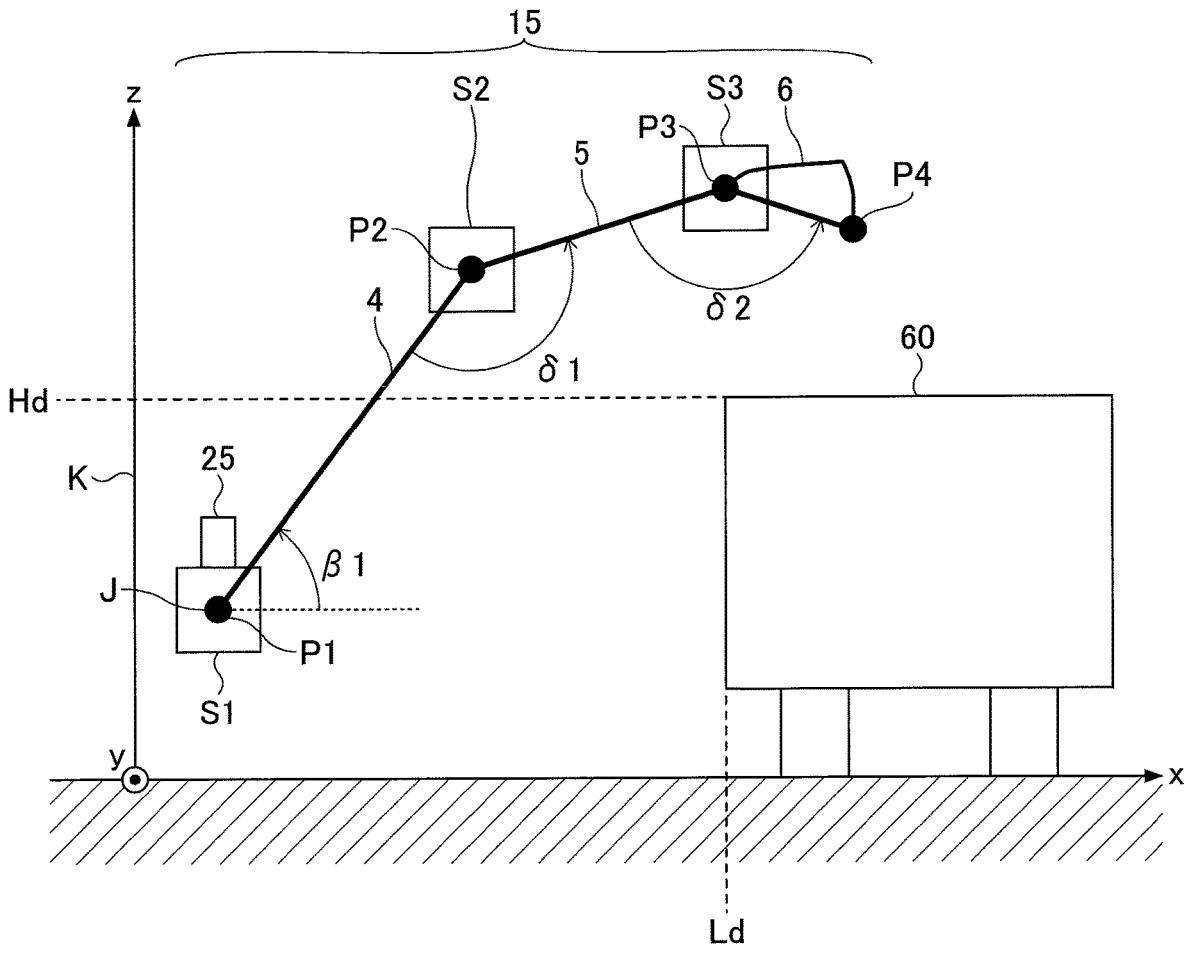
FIG. 3 is a schematic diagram illustrating the vertical and the horizontal positional relationship between the shovel and a dump truck.

Here, the vertical and the horizontal positional relationship between the attachment 15 and a dump truck 60 are described with reference to FIG. 3.

The boom 4 vertically pivots about a pivot center J parallel to the y-axis. The arm 5 is attached to an end of the boom 4, and the bucket 6 is attached to an end of the arm 5. The boom angle sensor S1, the arm angle sensor S2, and the bucket angle sensor S3 are attached to a base P1 of the boom 4, a connection P2 of the boom 4 and the arm 5, and a connection P3 of the arm 5 and the bucket 6, respectively. The boom angle sensor S1 measures an angle β1 between a longitudinal direction of the boom 4 and a reference horizontal plane (the xy plane). The arm angle sensor S2 measures an angle δ1 between the longitudinal direction of the boom 4 and a longitudinal direction of the arm 5. The bucket angle sensor S3 measures an angle δ2 between the longitudinal direction of the arm 5 and a longitudinal direction of the bucket 6. Here, the longitudinal direction of the boom 4 indicates a direction of a straight line passing through the pivot center J and the connection P2 in a plane perpendicular to the pivot center J (the zx plane). The longitudinal direction of the arm 5 indicates a direction of a straight line passing through the connection P2 and the connection P3 in the zx plane. The longitudinal direction of the bucket 6 indicates a direction of a straight line passing through the connection P3 and an end P4 of the bucket 6 in the zx plane. The pivot center J is placed at a position offset from a turning center K (the z-axis). The pivot center J may be placed so that the turning center K and the pivot center J cross each other.

The object detecting device 25 is attached to the shovel. The object detecting device 25 measures a distance Ld between the shovel and the dump truck 60 and a height Hd of the dump truck 60.

Figure 4:
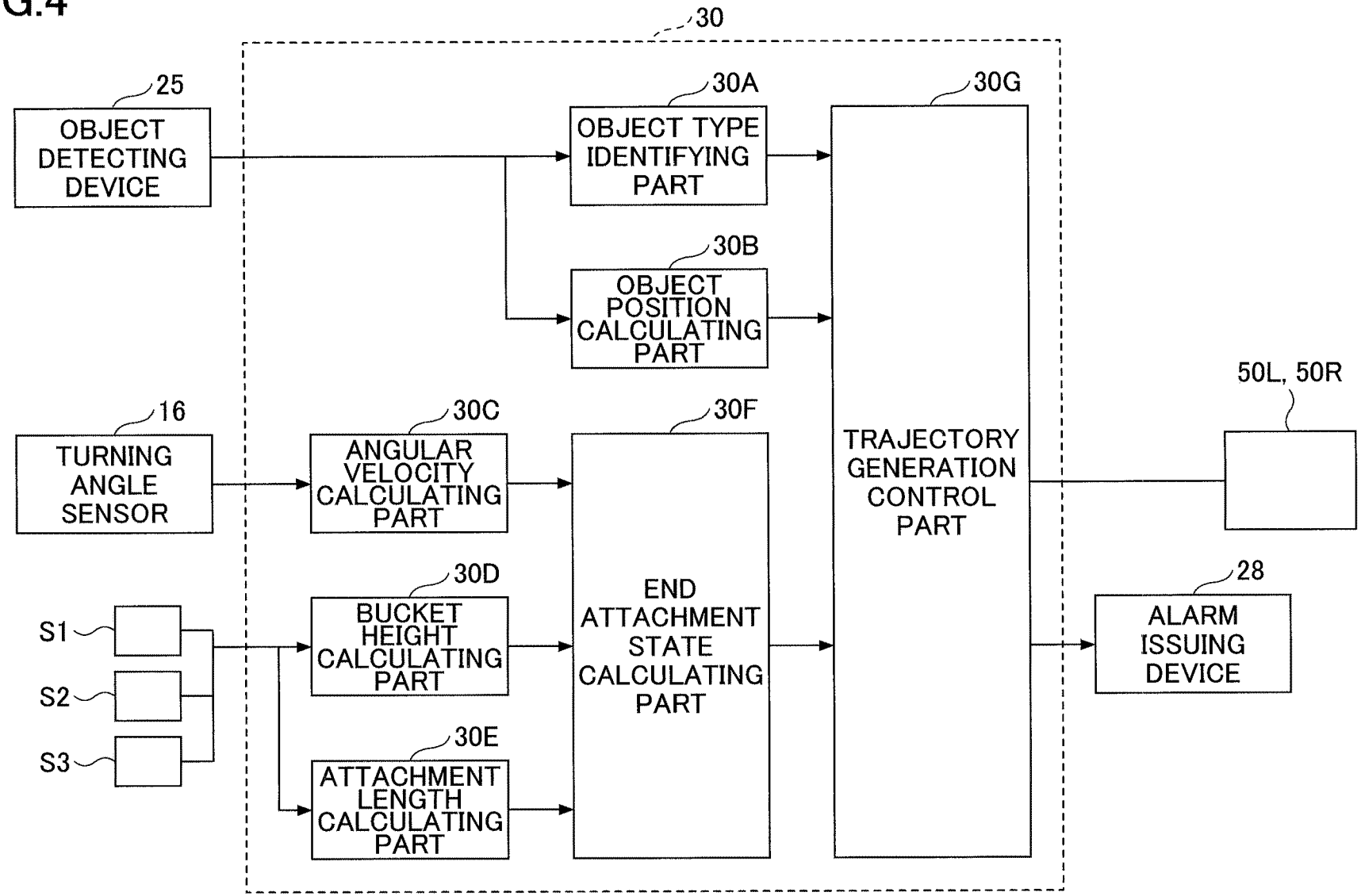
FIG. 4 is a block diagram illustrating a configuration of the shovel according to an embodiment.

FIG. 4 illustrates a functional block diagram of the shovel of this embodiment. The measurement results (such as image data) of the object detecting device 25, the measurement result of the turning angle sensor 16, and the measurement results of the boom angle sensor S1, the arm angle sensor S2, and the bucket angle sensor S3 are input to the controller 30 serving as a control part.

The controller 30 includes an object type identifying part 30A, an object position calculating part 30B, an angular velocity calculating part 30C, a bucket height calculating part 30D, an attachment length calculating part 30E, an end attachment state calculating part 30F, and a trajectory generation control part 30G. The controller 30 operates as a main control part to control the driving of the shovel. The controller 30 is composed of a processing unit including a CPU and an internal memory. The CPU executes a computer program stored in the internal memory to implement various functions of the controller 30, for example, the functions of the above-described parts 30A through 30G.

The object type identifying part 30A analyzes, for example, image data input from the object detecting device 25 to identify the type of an object.

The object position calculating part 30B analyzes, for example, image data and millimeter wave data input from the object detecting device 25 to calculate the position of the object. Specifically, the object position calculating part 30B calculates the coordinates (Ld, Hd) of the dump truck 60 illustrated in FIG. 3.

The angular velocity calculating part 30C calculates an angular velocity ω of the attachment 15 around a turning axis based on a change in the turning angle input from the turning angle sensor 16.

The bucket height calculating part 30D calculates a height Hb of the end of the bucket 6 based on detection results input from the boom angle sensor S1, the arm angle sensor S2, and the bucket angle sensor S3. The attachment length calculating part 30E calculates an attachment length R based on detection results input from the boom angle sensor S1, the arm angle sensor S2, and the bucket angle sensor S3.

Figure 5:
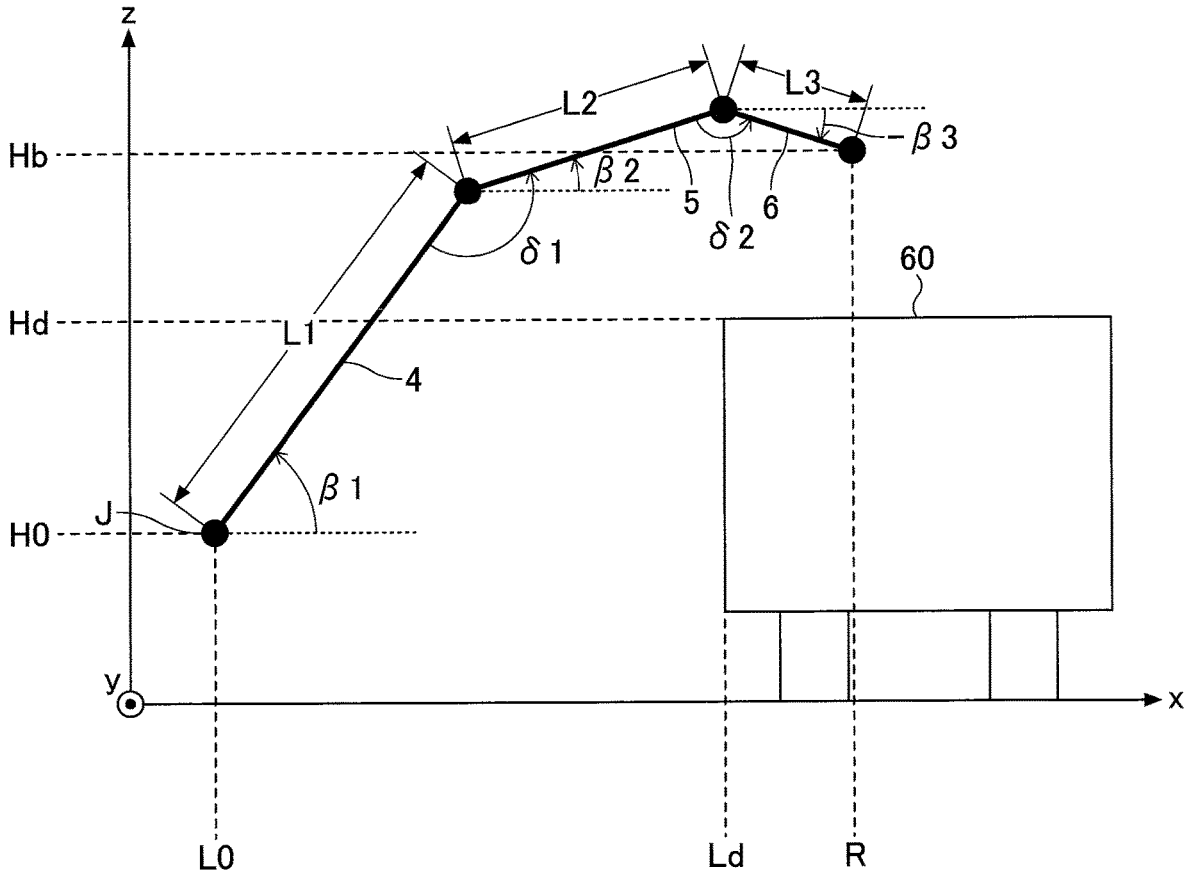
FIG. 5 is a schematic diagram of an attachment, illustrating the concept of calculating the position of a bucket.

A method of calculating the bucket height Hb and the attachment length R is described with reference to FIG. 5. It is assumed that the boom 4, the arm 5, and the bucket 6 have a length L1, a length L2, and a length L3, respectively. The angle β1 is measured by the boom angle sensor S1. The angle δ1 and the angle δ2 are measured by the arm angle sensor S2 and the bucket angle sensor S3. A height H0 of the pivot center J from the xy plane is predetermined. Furthermore, a distance L0 from the turning center K (the z-axis) to the pivot center J also is predetermined.

An angle 132 between the xy plane and the longitudinal direction of the arm 5 is calculated from the angle β1 and the angle δ1. An angle β3 between the xy plane and the longitudinal direction of the bucket 6 is calculated from the angle β1, the angle δ1, and the angle δ2. The bucket height Hb and the attachment length R are calculated by the following equations:

$$Hb=H0+L1\cdot\sin\beta1+L2\cdot\sin\beta2+L3\cdot\sin\beta3, \text{ and}$$

$$R=L0+L1\cdot\cos\beta1+L2\cdot\cos\beta2+L3\cdot\cos\beta3.$$

As described above, the attachment length R and the bucket height Hb are calculated based on detection values measured by the boom angle sensor S1, the arm angle sensor S2, and the bucket angle sensor S3. The bucket height Hb corresponds to the height of the end of the attachment 15 with the xy plane serving as a reference for height.

The end attachment state calculating part 30F calculates the state of the bucket 6 based on the angular velocity ω determined by the angular velocity calculating part 30C, the bucket height Hb determined by the bucket height calculating part 30D, and the attachment length R determined by the attachment length calculating part 30E. The state of the bucket 6 includes the position, velocity, acceleration, and posture of the bucket 6.

The trajectory generation control part 30G generates a movement trajectory line as a target line, serving as a target along which the bucket 6 moves during an excavating and loading operation, based on information on the state of the bucket 6 calculated by the end attachment state calculating part 30F and the position information and the height information of the dump truck 60 calculated by the object position calculating part 303. The movement trajectory line is, for example, a trajectory that the end of the bucket 6 follows. Alternatively, the movement trajectory line may be generated using a calculation table stored in the trajectory generation control part 30G. The excavating and loading operation is an operation to move the bucket 6 from a position where excavation is completed to a position above the dump truck 60, and is a boom raising and turning operation in this example.

The trajectory generation control part 30G outputs control signals to the pressure reducing valves 50L and 50R to control the movements of the boom 4 and the upper turning structure 3 so that the bucket 6 is along the movement trajectory line. At this point, the movement of at least one of the arm 5 and the bucket 6 may be suitably controlled.

The trajectory generation control part 30G outputs a control signal to an alarm issuing device 28 to cause the alarm issuing device 28 to issue an alarm when the bucket 6 does not move along the movement trajectory line. It is possible to determine from information from the end attachment state calculating part 30F whether the bucket 6 is moving along the movement trajectory line.

Next, a trajectory of movement generated by the trajectory generation control part 30G is described with reference to FIG. 6.

The bucket 6 loaded with excavated soil can follow two main patterns of a trajectory of movement in the excavating and loading operation.

The first pattern is a trajectory of movement that follows a movement trajectory line K1. That is, the bucket 6 is substantially vertically raised by the boom 4 from an excavation completion position (A) where excavation is completed to a bucket position (C) via a bucket position (B). The height of the bucket position (C) in this case is more than the height of the dump truck 60. Then, the bucket 6 is moved to a loading position (D) to load the dump truck 60 with excavated soil by the turning of the upper turning structure 3. At this point, the arm 5 is suitably opened and closed. According to the first pattern, the risk that the bucket 6 contacts the dump truck 60 is low, but an unnecessarily large vertical movement and an unnecessarily long travel distance result in poor fuel efficiency.

The second pattern is a trajectory of movement that follows a movement trajectory line K2. The movement trajectory line K2 is a trajectory line along which the bucket 6 travels the shortest distance to the loading position (D). Specifically, the bucket 6 is moved from the excavation completion position (A) to the loading position (D) via the bucket position (B) by boom raising and turning.

Figure 6:
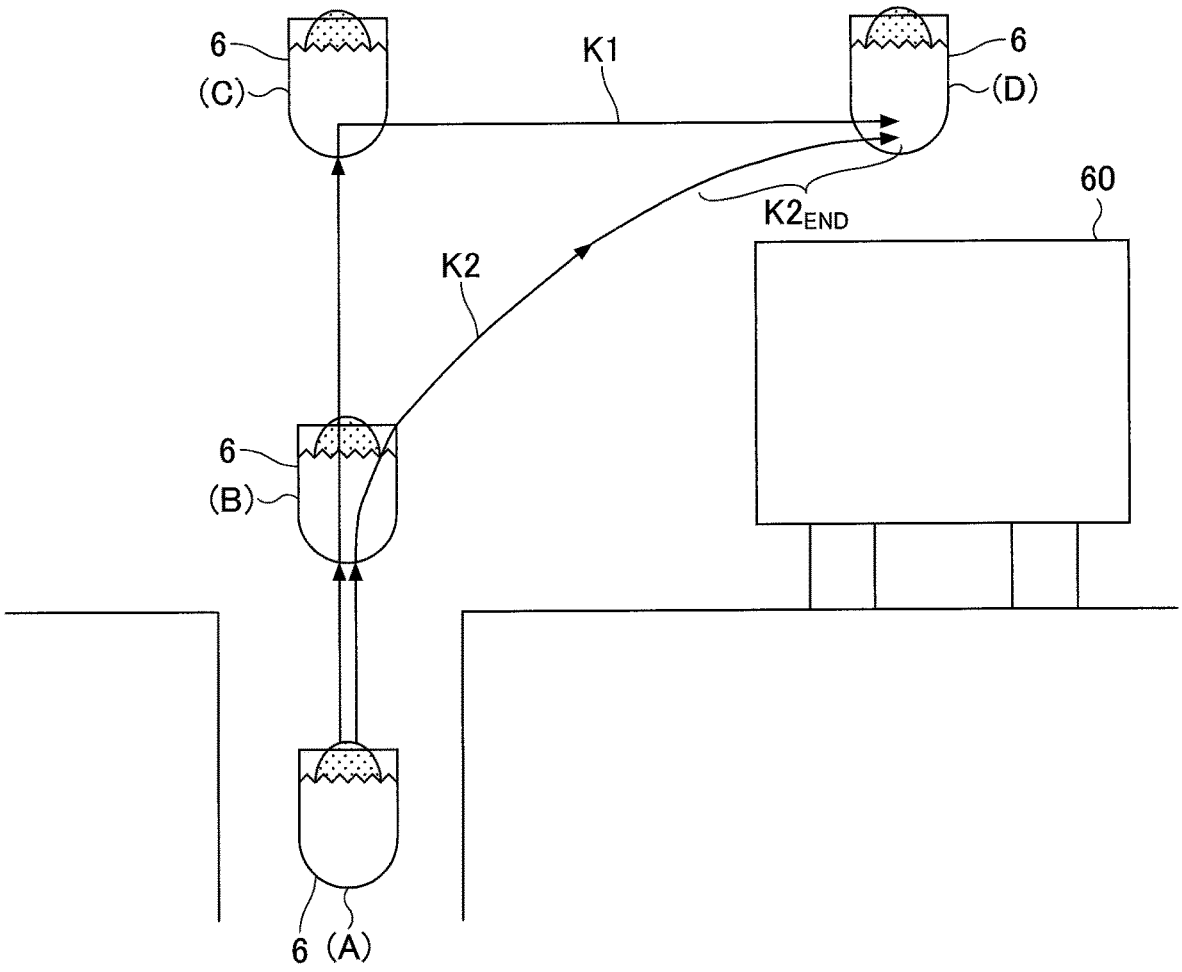
FIG. 6 is a schematic diagram illustrating a movement trajectory line.

In the illustration of FIG. 6, the excavation completion position (A) is at a position lower than the bucket position (B), namely, a position lower than a plane in which the dump truck 60 is positioned. The excavation completion position (A), however, may alternatively be at a position higher than the plane in which the dump truck 60 is positioned.

Conventionally, in the case of attempting to move the bucket 6 along the movement trajectory line K2, high operation performance is required of the operator because there is a relatively high probability that the bucket 6 will contact the dump truck 60. This results in slower attachment operations (such as boom raising and arm opening and closing), turning operation, etc., thus degrading the efficiency of loading work.

The trajectory generation control part 30G generates the movement trajectory line K2 based on the relative positional relationship between the position (posture) of the bucket 6 and the position (distance Ld and height Hd) of the dump truck 60, and controls the boom 4 and the upper turning structure 3 along the movement trajectory line K2. At this point, the arm 5 may be controlled to suitably slow the movement of the arm 5. Furthermore, the amount of lever operation of each of the boom operation lever 16A and the turning operation lever 19A may be constant. Accordingly, the operator can cause the bucket 6 to travel the shortest distance from the excavation completion position (A) to the loading position (D) without unnecessary deceleration even with the amount of lever operation being kept constant.

Specifically, the trajectory generation control part 30G controls at least one of the boom 4 and the upper turning structure 3 so that the end of the bucket 6 is along the movement trajectory line K2. For example, the trajectory generation control part 30G semi-automatically controls the turning speed of the upper turning structure 3 in accordance with the rising speed of the boom 4. Typically, the turning speed of the upper turning structure 3 is increased as the rising speed of the boom 4 increases. In this case, while the boom 4 rises at a speed commensurate with the amount of lever operation of the boom operation lever 16A manually operated by the operator, the upper turning structure 3 may turn at a speed different from a speed commensurate with the amount of lever operation of the turning operation lever 19A manually operated.

Alternatively, the trajectory generation control part 30G may semi-automatically control the rising speed of the boom 4 in accordance with the turning speed of the upper turning structure 3. For example, the rising speed of the boom 4 is increased as the turning speed of the upper turning structure 3 increases. In this case, while the upper turning structure 3 turns at a speed commensurate with the amount of lever operation of the turning operation lever 19A manually operated by the operator, the boom 4 may rise at a speed different from a speed commensurate with the amount of lever operation of the boom operation lever 16A manually operated.

As yet another alternative, the trajectory generation control part 30G may semi-automatically control both the turning speed of the upper turning structure 3 and the rising speed of the boom 4. In this case, the upper turning structure 3 may turn at a speed different from a speed commensurate with the amount of lever operation of the turning operation lever 19A manually operated. Likewise, the boom 4 may rise at a speed different from a speed commensurate with the amount of lever operation of the boom operation lever 16A manually operated.

The trajectory generation control part 30G may generate multiple movement trajectory lines and display the movement trajectory lines on a display part installed in the cabin 10, and may cause the operator to select an appropriate movement trajectory line.

Furthermore, the trajectory generation control part 30G may perform control so that the movements of the boom 4 and the upper turning structure 3 become slower when the bucket 6 enters a final position range $K2_{END}$ of the movement trajectory line K2. The final position range $K2_{END}$ indicates a distance from the loading position (D) along the movement trajectory line K2, determined according to the travel (movement) speed of the bucket 6. This control makes it possible to smoothly stop the bucket 6. At this point, such control as to appropriately slow the movement of the arm 5 may be performed. This control makes it easier for the operator to perform an operation to stop the bucket 6 at the loading position (D).

Figure 7:
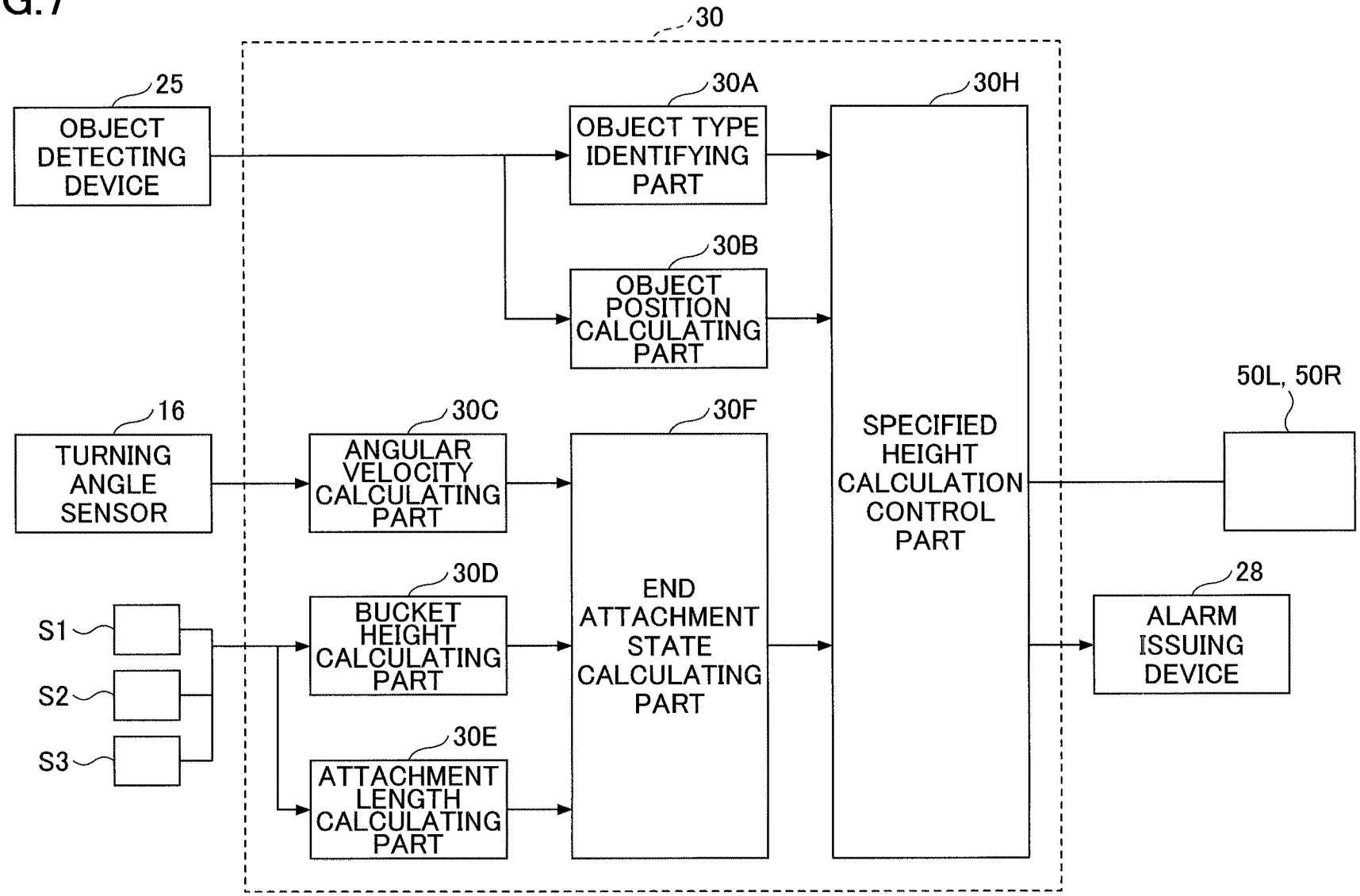
FIG. 7 is a block diagram illustrating a configuration of the shovel according to another embodiment.

Next, a shovel according to another embodiment is described. The other embodiment has the same technical idea as the above-described embodiment, and their differences alone are described below. FIG. 7 is a block diagram illustrating a configuration of the shovel according to the other embodiment.

The controller 30 illustrated in FIG. 7 is different from the controller 30 illustrated in FIG. 4 in including a specified height calculation control part 30H in place of the trajectory generation control part 30G.

The specified height calculation control part 30H calculates a specified height position as a threshold, based on information related to the state of the bucket 6 calculated by the end attachment state calculating part 30F and the position information and height information of the dump truck 60 calculated by the object position calculating part 30B. The specified height position may be calculated using a calculation table stored in the specified height calculation control part 30H. The specified height calculation control part 30H performs such control as to slow the movements of the boom 4 and the upper turning structure 3 when the bucket 6 reaches a specified height serving as a threshold. At this point, such control as to appropriately slow the movement of the arm 5 may be performed. Furthermore, the amount of lever operation of each of the boom operation lever 16A and the turning operation lever 19A may be constant.

Figure 8:
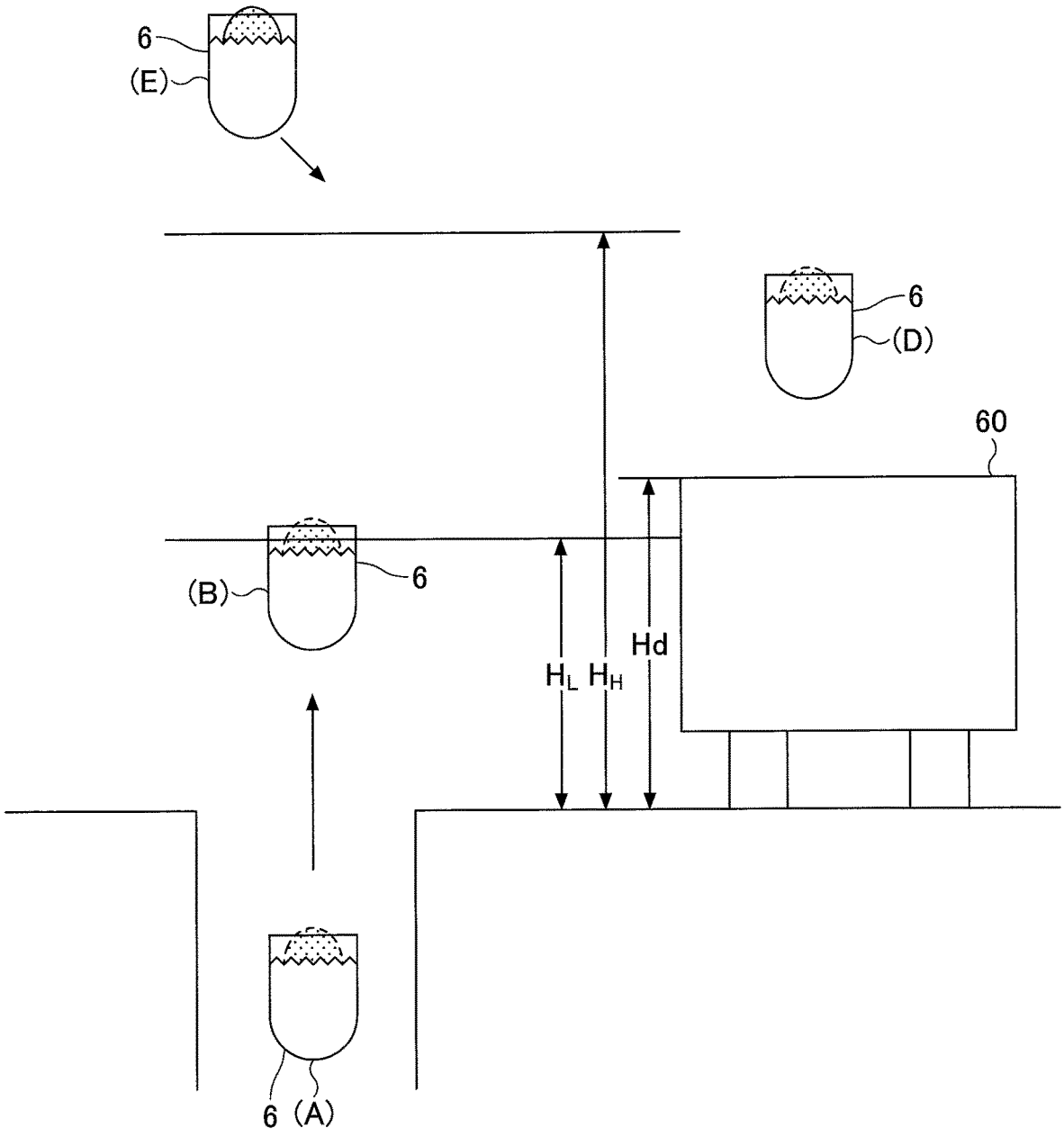
FIG. 8 is a schematic diagram illustrating a specified height.

FIG. 8 illustrates a specified height calculated by the specified height calculation control part 30H. First, the specified height calculation control part 30H calculates a specified height position $H_L$. The specified height position $H_L$ is calculated in the case of moving the bucket 6 from the excavation completion position (A) to the loading position (D) via the bucket position (B).

For example, when the end attachment state calculating part 30F determines that the bucket 6 is at the excavation completion position (A), the specified height calculation control part 30H calculates the specified height position $H_L$. The specified height position $H_L$ of this embodiment is calculated to be lower than the height Hd of the dump truck 60. The specified height position $H_L$ of the illustration is substantially equal to the height position of the bucket position (B).

When the bucket 6 moves from the excavation completion position (A) to the bucket position (B) to reach the specified height position $H_L$, the specified height calculation control part 30H controls the pressure reducing valves 50L and 50R to decelerate the movements of the boom 4 and the upper turning structure 3. The movement of the arm 5 as well may be likewise decelerated. Furthermore, control may be so performed as not to decelerate turning.

Accordingly, the controller 30 serving as a control part can improve operation performance in moving the bucket 6 from the bucket position (B) to the loading position (D) to avoid the contact of the bucket 6 with the dump truck 60 and cause the bucket 6 to travel the shortest distance to above the dump truck 60. At this point, the amount of lever operation of each of the boom operation lever 16A and the turning operation lever 19A may be constant.

Next, a specified height position $H_H$ calculated by the specified height calculation control part 30H is described. The specified height position $H_H$ is a specified height position calculated in the case of moving the bucket 6 from an excavation completion position (E) to the loading position (D).

In the excavating and loading operation, the position of the shovel and an excavating position may be higher than the position of the dump truck 60. In this case, the bucket 6 is at the excavation completion position (E). In this case, the operator moves the bucket 6 from the excavation completion position (E) to the loading position (D) to perform a loading operation.

For example, when the end attachment state calculating part 30F determines that the bucket 6 is at the excavation completion position (E), the specified height calculation control part 30H calculates the specified height position $H_H$. The specified height position $H_H$ of this embodiment is higher than the height Hd of the dump truck 60 and lower than the excavation completion position (E).

When the bucket 6 moves downward from the excavation completion position (E) to reach the specified height position $H_H$, the specified height calculation control part 30H controls the pressure reducing valves 50L and 50R to decelerate the movements of the boom 4 and the upper turning structure 3. Therefore, the operability of the bucket 6 is improved, so that it becomes easier to stop the bucket 6 above the dump truck 60.

Preferred embodiments of the present invention are described in detail above. The present invention, however, is not limited to the above-described specific embodiments. Various changes, modifications, etc., may be applied to the above-described embodiments without departing from the scope of the present invention. For example, control combining control by the movement trajectory line and control by the specified height may be performed.

What is claimed is:

1. A shovel comprising:
a traveling undercarriage;
an upper turning structure turnably mounted on the traveling undercarriage;
an attachment including a boom attached to the upper turning structure, an aim attached to the boom, and an end attachment attached to the arm;
an object detecting device configured to detect an object in an area around the shovel; and
a processor configured to calculate a position at which the end attachment is located when excavation with the end attachment is completed, calculate a position of the object detected by the object detecting device, and control a movement of at least one of the attachment and the upper turning structure, based on a relative positional relationship between the calculated position of the end attachment and the calculated position of the object.

2. The shovel as claimed in claim 1, wherein the processor is configured to calculate a target line serving as a target along which the end attachment moves, based on the relative positional relationship, and to control the movement of the at least one of the attachment and the upper turning structure along the calculated target line.

3. The shovel as claimed in claim 2, wherein the processor is configured to slow movements of the attachment and the upper turning structure within a final position range of the target line.

4. The shovel as claimed in claim 2, wherein the target line is a trajectory line along which the end attachment travels a shortest distance to a target position while avoiding a contact with the object.

5. The shovel as claimed in claim 2, wherein the target line is generated between the object and a movement trajectory line in a case of independently performing a turning operation to a loading position after independently performing a boom raising operation from the calculated position of the end attachment.

6. The shovel as claimed in claim 1, wherein the processor is configured to slow the movement of the at least one of the attachment and the upper turning structure, the movement being responsive to a lever operation, when a height position of the end attachment reaches a threshold.

7. The shovel as claimed in claim 1, wherein the relative positional relationship includes height information, and the object detecting device is configured to detect a height of the object.

8. The shovel as claimed in claim 1, wherein the processor is configured to control a control pressure to a flow control valve, the control pressure being generated by a lever operation.

9. The shovel as claimed in claim 1, wherein the object detecting device includes at least one of a camera and a millimeter wave radar.

* * * * *